US006851993B2

(12) United States Patent
Takada et al.

(10) Patent No.: US 6,851,993 B2
(45) Date of Patent: Feb. 8, 2005

(54) OUTBOARD MOTOR

(75) Inventors: Hideaki Takada, Wako (JP); Hiroshi Mizuguchi, Wako (JP); Hiroshi Watabe, Wako (JP); Yoshinori Masubuchi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/446,788

(22) Filed: May 29, 2003

(65) Prior Publication Data

US 2003/0224673 A1 Dec. 4, 2003

(30) Foreign Application Priority Data

May 31, 2002 (JP) ..... 2002-160319

(51) Int. Cl.[7] ..... B63H 21/10
(52) U.S. Cl. ..... 440/88 A
(58) Field of Search ..... 440/84, 88 A, 440/88 F, 77

(56) References Cited

U.S. PATENT DOCUMENTS 4,883,616 A * 11/1989 Covey, Jr. ..... 261/64.4
6,032,647 A * 3/2000 Sato et al. ..... 123/399
2001/0003691 A1 * 6/2001 Watanabe ..... 440/88
2001/0030518 A1 * 10/2001 Reimann ..... 318/254

FOREIGN PATENT DOCUMENTS

JP 02-279495 11/1990

* cited by examiner

*Primary Examiner*—Stephen Avila
(74) *Attorney, Agent, or Firm*—Westerman, Hattori, Daniels & Adrian, LLP

(57) ABSTRACT

In An outboard motor mounted on a stem of a boat and having an internal combustion engine, a throttle body (that accommodates the throttle valve) is installed at a position close to the boat, and an electric motor is fastened to the throttle body so as to drive the throttle valve to open or close through a simple gear mechanism. This arrangement can mitigate operation load and offer improved operation feel. Further, it is simpler than a cable or a link mechanism, does not lead to an increase in number of components or weight, and hence the amount of required installation space can be reduced. A knob is provided and the operator can pinch and rotate it to open the throttle valve manually, when the electric motor breaks down.

7 Claims, 5 Drawing Sheets

OUTBOARD MOTOR

BACKGROUND OF THE INVENTION

1. Field of the Invention

This invention relates to an outboard motor.

2. Description of the Related Art

In outboard motors, manipulation of a throttle lever installed at a hull (boat) on which outboard motor is mounted, is usually transmitted to a throttle valve in an internal combustion engine (equipped in the outboard motor) through a cable to move the same to regulate the amount of air to be sucked into the engine.

When the throttle valve is operated manually through the cable, since the operator tends to have an unpleasant operation "feel" owing to, for instance, heavy load, an actuator has often been installed at the hull, that is connected to the engine throttle valve through the cable to power-assist the driving of the throttle valve. The add-on system using such an actuator has disadvantage that it takes up space at the hull for installing the actuator.

Attempts have been made to overcome the drawback. Japanese Laid-Open Patent Application No. Hei 2(1990)-279495 ('495), for example, teaches installing an actuator inside an engine cover at a position remote from the throttle valve (carburetor) in such a manner that the actuator is connected to the throttle valve through a link mechanism. However, this arrangement is disadvantageous in that its structure is complicated, that it adds to the number and weight of the components, and it needs a space for the link mechanism inside the engine cover. Moreover, since the prior art actuator is positioned inside the engine cover to be extended from the middle or center to the rear (i.e., the side opposite to the hull), maintenance operation from the hull is not satisfactory.

SUMMARY OF THE INVENTION

An object of the present invention is therefore to overcome the foregoing issues by providing an outboard motor that improves operation feel, is simply configured to avoid increase in number and weight of components, and does not cause a problem regarding space utilization, while facilitating maintenance operation from the hull.

In order to achieve the foregoing object, this invention provides an outboard motor mounted on a stern of a boat and having an internal combustion engine at its upper portion and a propeller with a rudder at its lower portion that is powered by the engine to propel the boat, the engine being concealed by a cover and having a throttle valve that regulates air to be sucked, comprising: a throttle body installed inside the engine that accommodates the throttle valve; and an actuator fastened to the throttle body to drive the throttle valve to open or close; wherein the throttle body is placed in the cover at a position close to the boat.

BRIEF DESCRIPTION OF THE DRAWINGS

The above and other objects and advantages of the invention will be more apparent from the following description and drawings, in which.

DETAILED DESCRIPTION OF THE PREFERRED EMBODIMENTS

An outboard motor according to an embodiment of the present invention will now be explained with reference to the attached drawings.

Figure 1:
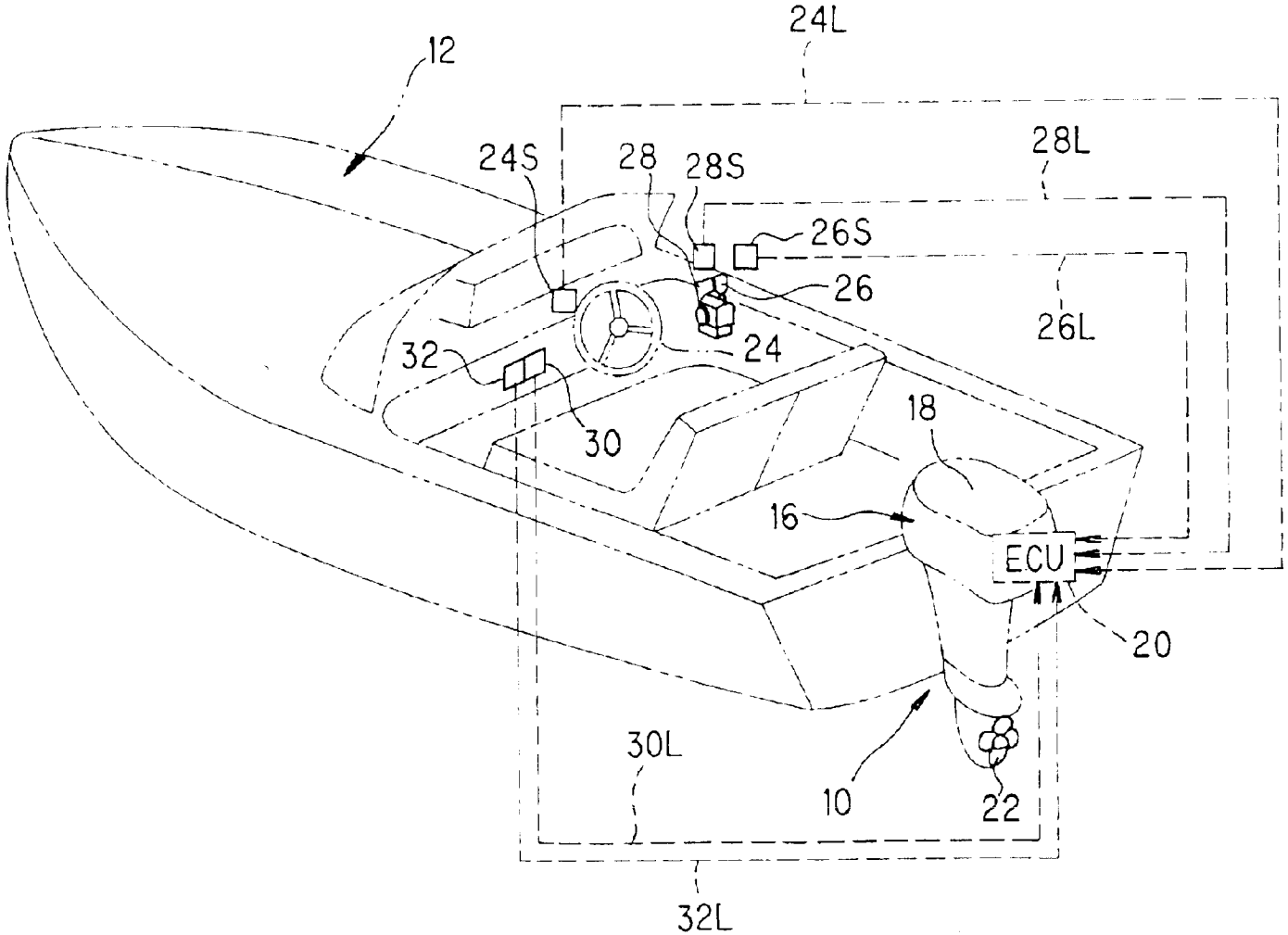
FIG. 1 is an overall schematic view of an outboard motor according to an embodiment of the invention.
Figure 2:
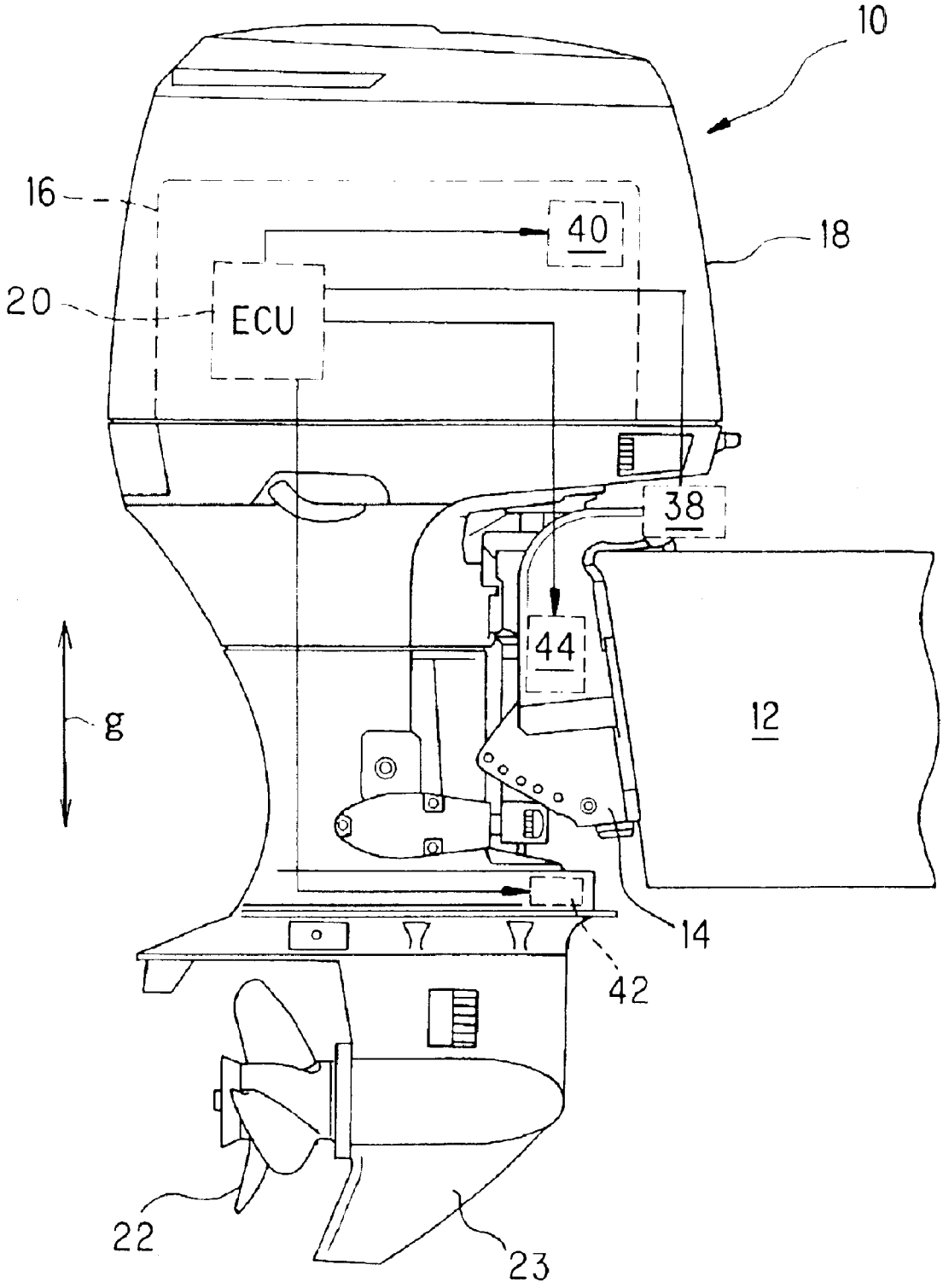
FIG. 2 is an explanatory side view of a part of FIG. 1.

FIG. is an overall schematic view of the outboard motor, and FIG. 2 is an explanatory side view of a part of FIG. 1.

Reference numeral 10 in FIGS. 1 and 2 designates an outboard motor built integrally of an internal combustion engine, propeller shaft, propeller and other components. The outboard motor 10 is mounted on the stem of a hull (boat) 12 via stern brackets 14 (shown in FIG. 2).

As shown in FIG. 2, the outboard motor 10 is equipped with an internal combustion engine 16 at its upper portion (in the gravitational direction indicated by the arrow g). The engine 16 is a spark-ignition, in-line four-cylinder gasoline engine with a displacement of 2,200 cc. The engine 16, located inside the outboard motor 10, is enclosed by an engine cover 18 and positioned above the water surface. An electronic control unit (ECU) 20 constituted of a microcomputer is installed near the engine 16 enclosed by the engine cover 18.

The outboard motor 10 is equipped at its lower part with a propeller 22 and a rudder 23. The rudder 23 is fixed near the propeller 22 and does not rotate independently. The propeller 22, which operates to propel the boat 12 in the forward and reverse directions, is powered by the engine 16 through a crankshaft, drive shaft, gear mechanism and shift mechanism (none of which is shown), as will be explained later.

As shown in FIG. 1, a steering wheel 24 is installed near the operator's seat of the boat 12, and a steering angle sensor 24S installed near the steering wheel 24 outputs a signal in response to the turning of the steering wheel 24 by the operator. A throttle lever 26 is mounted on the right side of the operator's seat, and a throttle lever position sensor 26S installed near the throttle lever 26 outputs a signal in response to the position of the throttle lever 26 by the operator.

A shift lever 28 is mounted on the right side of the operator's seat near the throttle lever 26, and a shift lever position sensor 28S is installed near the shift lever 28 and outputs a signal in response to the position of the shift lever 28 by the operator.

A power tilt switch 30 for regulating the tilt angle and a power trim switch 32 for regulating the trim angle of the outboard motor 10 are also installed near the operator's seat. These switches output signals in response to tilt up/down and trim up/down instructions input by the operator. The outputs of the steering angle sensor 24S, power tilt switch 30 and power trim switch 32 are sent to the ECU 20 over signal lines 24L, 30L and 32L.

In response to the output of the steering angle sensor 24S sent over the signal line 24L, the ECU 20 operates an electric motor 38 (for steer; shown in FIG. 2) to steer the outboard motor 10, i.e., change the direction of the propeller 22 and rudder 23, and thereby turn the boat 12 right or left.

In response to the output of the throttle lever position sensor 26S sent over the signal line 26L, the ECU 20 operates an electric motor 40 (for throttle) to move the throttle valve and regulate the amount of air to be sucked into the engine 16. Further, in response to the output of the shift lever position sensor 28S sent over the signal line 28L, the ECU 20 operates an electric motor 42 (for shift) to change the rotational direction of the propeller 22 or cut off the transmission of engine power to the propeller 22.

Moreover, in response to the outputs of the power tilt switch 30 and power trim switch 32 sent over the signal lines 30L, 32L, the ECU 20 operates a conventional power tilt-trim unit 44 to regulate the tilt angle and trim angle of the outboard motor 10.

Figure 3:
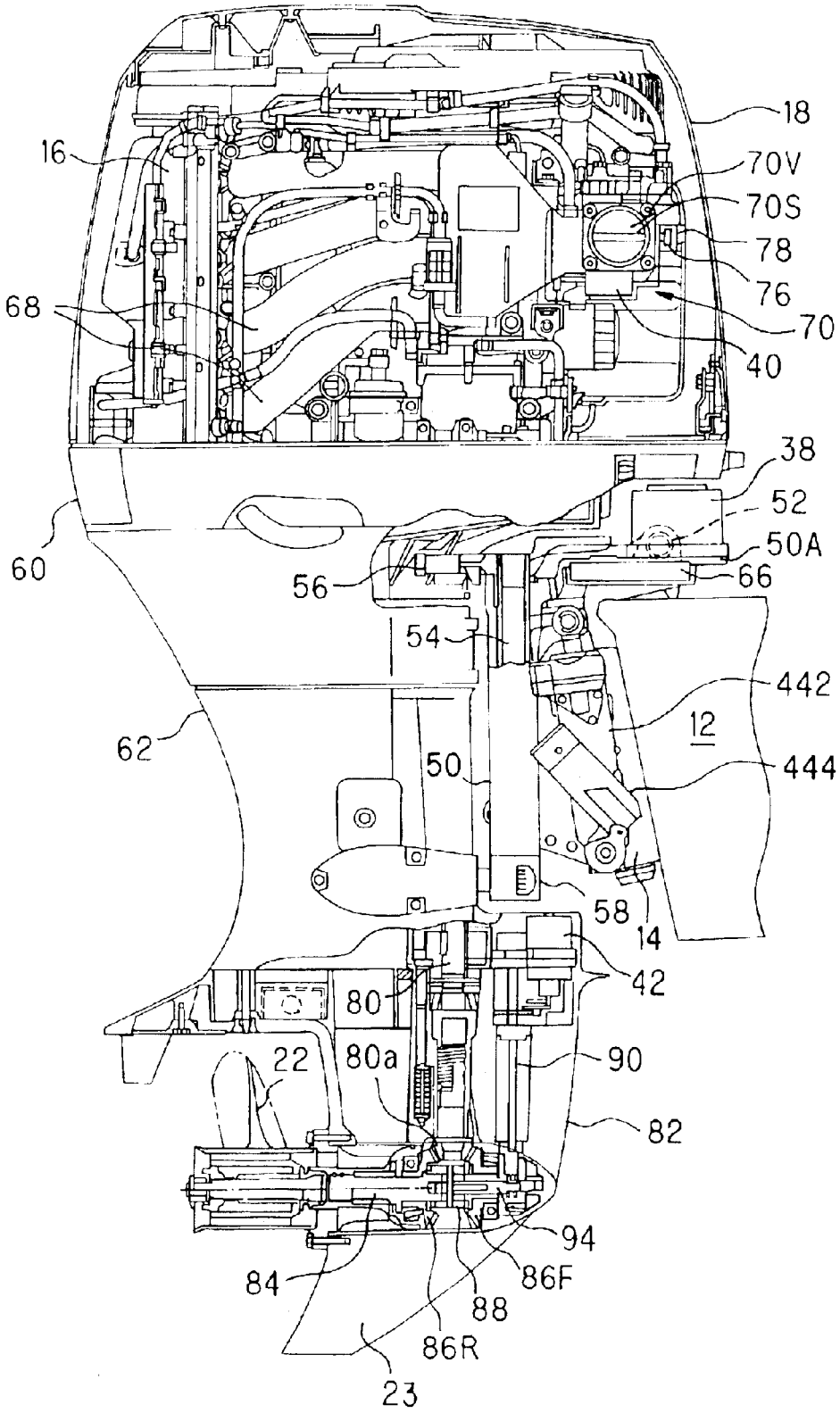
FIG. 3 is an enlarged explanatory side view of FIG. 2.

FIG. 3 is an enlarged explanatory side view. While this is basically an enlargement of FIG. 2, it should be noted that it is portrayed in a partially cutaway manner with the right side of the stern bracket 14 removed (the right side looking forward (toward the boat or hull 12)).

As illustrated in FIG. 3, the power tilt-trim unit 44 is equipped with one hydraulic cylinder 442 for tilt angle regulation (hereinafter called the "tilt hydraulic cylinder") and, constituted integrally therewith, two hydraulic cylinders 444 for trim angle regulation (hereinafter called the "trim hydraulic cylinders"; only one shown).

As shown in FIG. 3, one end of the tilt hydraulic cylinder 442 is fastened to the stem bracket 14 and through it to the boat 12 and the other end (piston rod) thereof is fastened to a swivel case 50. One end of each trim hydraulic cylinder 444 is fastened to the stem bracket 14 and through it to the boat 12, similarly to the one end of the tilt hydraulic cylinder 442, and the other end (piston rod) thereof abuts on the swivel case 50.

The swivel case 50 is connected to the stem bracket 14 through a tilting shaft 52 to be relatively displaceable about the tilting shaft 52. A swivel shaft 54 is rotatably accommodated inside the swivel case 50. The swivel shaft 54 has its upper end fastened to a mount frame 56 and its lower end fastened to a lower mount center housing 58. The mount frame 56 and lower mount center housing 58 are fastened to an under cover 60 and an extension case 62 (more exactly, to mounts covered by these members).

The electric motor 38 (for steer) and a gearbox (gear mechanism) 66 for reducing the output of the electric motor 38 are fastened to an upper portion 50A of the swivel case 50. The gearbox 66 is connected to the output shaft of the electric motor 38 at its input side and is connected to the mount frame 56 at its output side. To be more specific, horizontal steering of the outboard motor 10 is thus power-assisted using the rotational output of the electric motor 38 to swivel the mount frame 56 and thus turn the propeller 22 and rudder 23. The overall rudder turning angle of the outboard motor 10 is 60 degrees, 30 degrees to the left and 30 degrees to the right.

As shown in the figure, the engine 16 is installed at the upper portion of the under cover 60 and the engine cover 18 is fastened thereon to cover the engine 16. The engine 16 has a throttle body 70 that is placed at a front position (at a position close to the hull or boat 12) inside the engine cover 18. More precisely, the throttle body 70 placed inside the engine cover 18 at a position closer to the hull or boat 12 than the middle or center of the engine 16, as seen from FIG. 3. Sucked air flows through the throttle body 70 and an intake manifold 68, and is drawn into cylinders (not shown).

Figure 4:
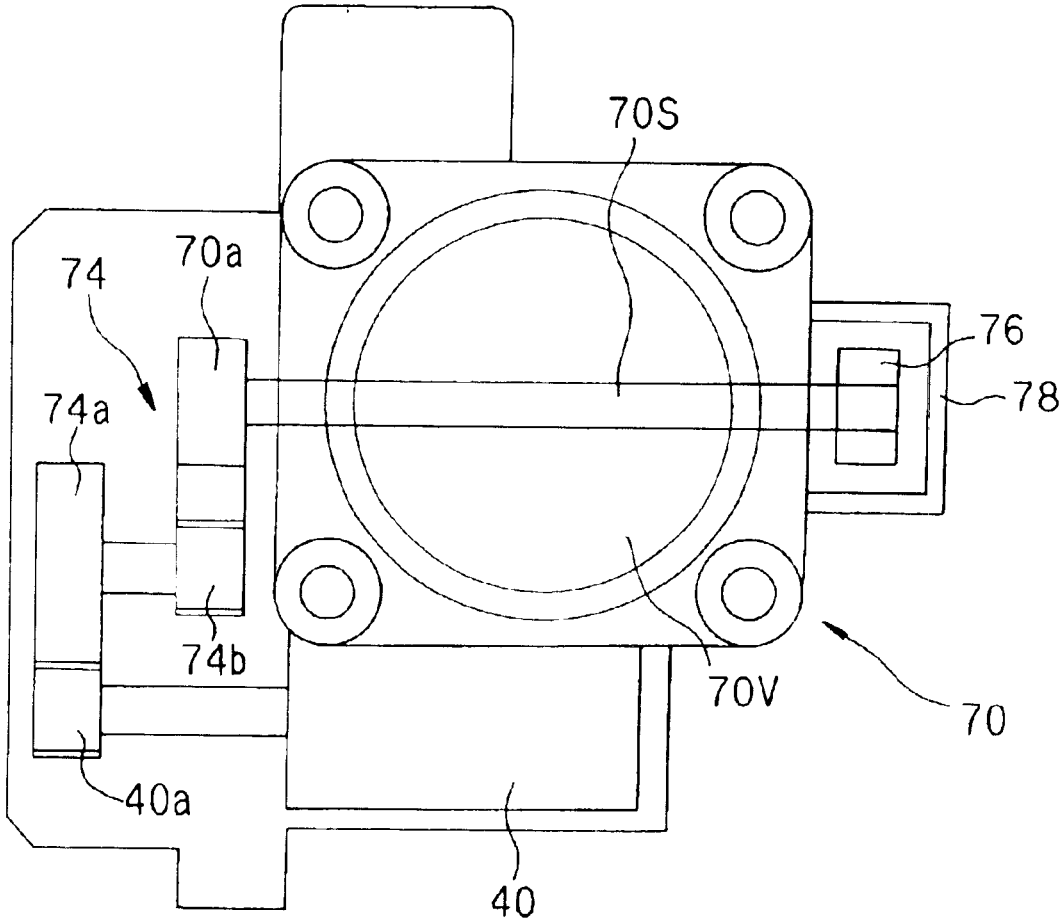
FIG. 4 is an enlarged sectional view of a throttle body illustrated in FIG. 3.
Figure 5:
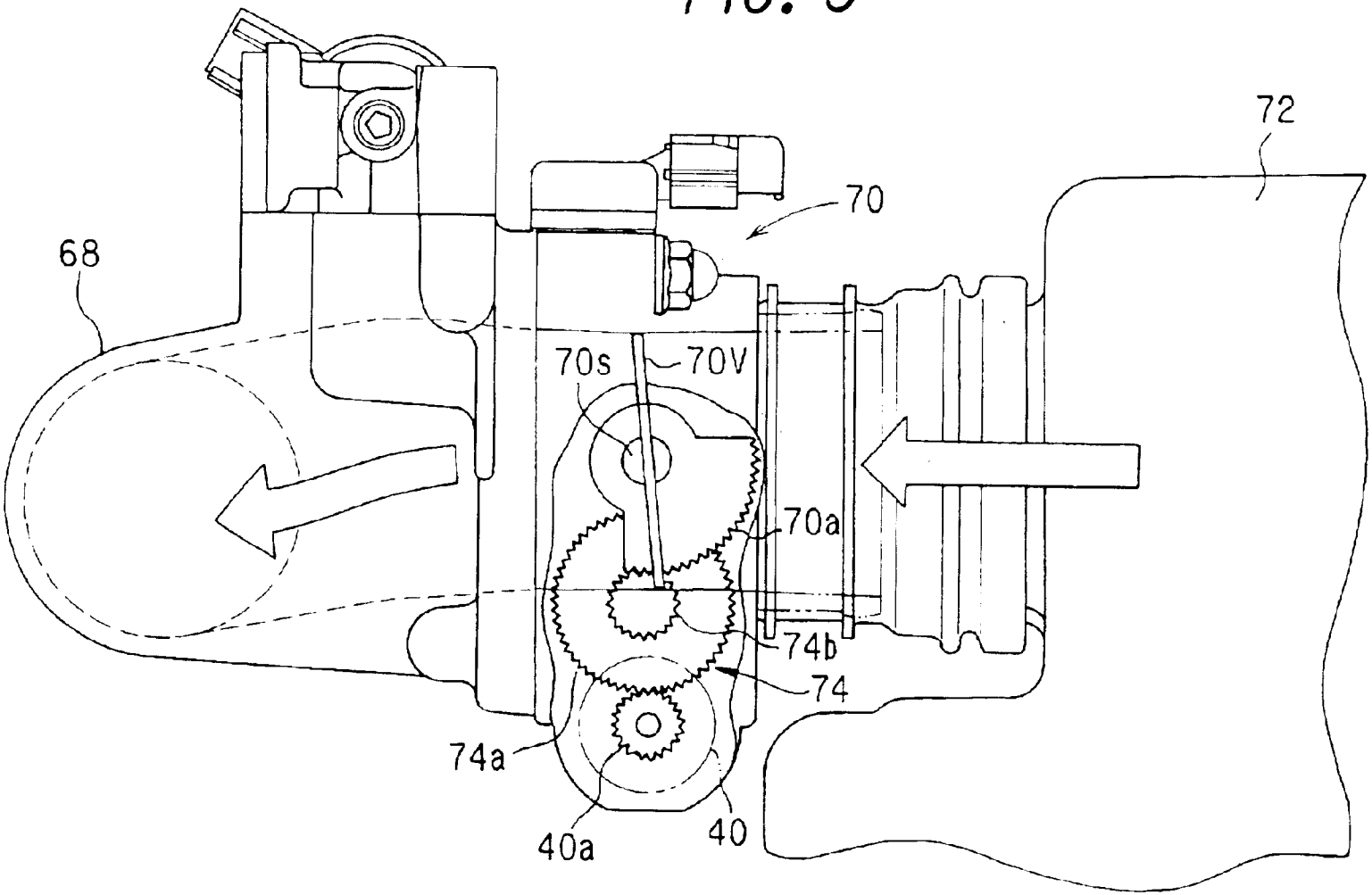
FIG. 5 is an explanatory sectional view of the throttle body (illustrated in FIG. 3) looking from the front (from the hull side) of the outboard motor.

FIG. 4 is an enlarged sectional view of a throttle body 70 illustrated in FIG. 3, and FIG. 5 is an explanatory sectional view of the throttle body 70 looking from the front (from the hull side) of the outboard motor 10.

As shown in FIGS. 3 to 5, air drawn from air intake port (not shown) flows through a silencer 72 (shown in FIG. 5) into the throttle body 70. The air flowing into the throttle body 70 is regulated by a throttle valve 70V installed inside the throttle body 70. The regulated air flows through the intake manifold 68 to the cylinders and is mixed with gasoline fuel injected by a fuel injector (not shown) and resultant air-fuel-mixture is supplied into the cylinders.

As best seen in FIGS. 4 and 5, the electric throttle motor (DC motor; actuator) 40 is integrally fastened to the throttle body 70 (i.e., the motor 40 is also placed inside the engine cover 18 at a position closer to the hull or boat 12 than the middle or center of the engine 16). Specifically, the electric motor 40 is connected to a throttle shaft 70S through a gear mechanism 74 provided adjacent to the throttle body 70. The throttle shaft 70V supports or carries the throttle valve 70V in such a way that the valve 70V rotates about the shaft 70S.

More specifically, an output shaft gear 40*a* fastened on the output shaft of the electric motor 40 meshes with a first gear 74*a* of larger diameter (having more teeth) than the output shaft gear 40*a*. A second gear 74*b* of smaller diameter (having fewer teeth) than the first gear 74*a* is fastened to the first gear 74*a* coaxially therewith.

The throttle shaft 70S is fixed with a throttle shaft gear 70*a* that has a larger diameter (having more teeth) than the second gear 74*b* and is formed in an arcuate shape. The second gear 74*b* meshes with the throttle shaft gear 70*a* to transmit the geared-down output of the electric motor 40 to the throttle shaft 70S so as to drive the throttle valve 70V to open or close.

The throttle shaft 70S is provided with a knob (second throttle valve driver) 76 at an end, opposite to the end where the throttle shaft gear 70*a* is fixed. The knob 76 is formed in a shape such that the operator can easily pinch and rotate to move the throttle valve 70V manually. The knob 76 is concealed by a cover 78 (that is detachable). After removing the engine cover 18 and the cover 78, the operator can easily handle the knob 76 from the boat or hull 12.

As mentioned in the above, since the electric motor 40 is integrally fastened to the throttle body 70 that accommodates the throttle valve 70V in such manner that the electric motor 40 drives the throttle shaft 70S to open or close the throttle valve 70V, this can mitigate the load and offer improved operation feel. Further, since the electric motor 40 is connected to the throttle valve 70V with the use of a gear mechanism that is simpler than a cable or a link mechanism, this does not lead to an increase in number of components or weight, and in addition the amount of required installation space can be reduced.

Further, since the throttle body 70 is placed in the engine cover 18 at a position close to the boat or hull 12, the electric motor 40 can be protected from being damaged by sea water or dust, and in addition, the maintenance operation from the hull 12 can be improved.

Furthermore, since the throttle shaft 70S is provided with the knob 76 in such a way that the operator can pinch and rotate to move the throttle valve 70V manually, without the use of the electric motor 40, even when the electric motor 40 breaks down, the throttle valve 70V can be opened (or closed) by manipulating the knob 76. In addition, the fact that the throttle body 70 is placed at a position close to the hull 12 can make the operator to easily manipulate the knob 76 without fail.

Returning to the explanation of FIG. 3, in the engine 16, the air-fuel mixture in the cylinder is combusted and resulting output is transmitted, via a crankshaft (not shown) and a drive shaft 80, to a propeller shaft 84 housed in a gear case 82 and to rotate the propeller 22. The rudder 23 is formed integrally with the gear case 82.

The propeller shaft 84 is provided with a forward gear 86F and a reverse gear 86R therearound, respective of which meshes with a drive gear 80*a* fixed to the drive shaft 80 and rotates in opposite directions. A clutch 88 is provided between the forward gear 86F and the reverse gear 86R to be rotated with the propeller shaft 84. By engaging the clutch 88 with the forward gear 86F or the reverse gear 86R through the operation of a shift rod 90 and a shift slider 94 that are driven by the electric motor (for shift) 42, the direction of propeller rotation is changed and the shift change is effected between the forward advancing and reverse advancing.

As mentioned above, there is provided an outboard motor 10 mounted on a stem of a boat (hull) 12 and having an internal combustion engine 16 at its upper portion and a propeller 22 with a rudder 23 at its lower portion that is powered by the engine to propel the boat, the engine being concealed by a cover (engine cover 18) and having a throttle valve 70V that regulates air to be sucked, comprising: a throttle body 70 installed inside the engine that accommodates the throttle valve 70V; and an actuator (electric motor 40) fastened to the throttle body to drive the throttle valve to open or close; wherein the throttle body 70 (and hence, the actuator 40) is placed in the cover 18 at a position close to the boat.

In the outboard motor 10, the actuator drives a shaft of the throttle valve (throttle shaft) 70S through a gear mechanism 74 to drive the throttle valve. The gear mechanism includes; an actuator gear (output shaft gear) 40*a* connected to the actuator; a first gear 74*a* meshed with the actuator gear and having more teeth than those of the actuator gear; a second gear 74*b* meshed with the first gear and having fewer teeth than those of the first gear; and a third gear (throttle shaft gear) 70*a* connected to the shaft of the throttle valve and meshed with the second gear. The actuator 40 is an electric motor.

The outboard motor 10 further includes: a second throttle valve driver that enables the throttle valve to be driven manually to close or open, the second throttle valve driver is a knob 76 that is connected a shaft of the throttle valve and is formed in a shape to be manually handled. The second throttle valve driver (knob 76) is placed at a position close to the boat or hull 12. The knob 76 is concealed by a detachable cover 78.

It should be noted in the above, although the electric motor (for throttle) 40 is configured to be a DC motor, it may be other motor such as a stepper motor.

The entire disclosure of Japanese Patent Application No. 2002-160319 filed on May 31, 2002, including specification, claims, drawings and summary, is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. An outboard motor mounted on a stern of a boat and having an internal combustion engine at its upper portion and a propeller with a rudder at its lower portion that is powered by the engine to propel the boat, the engine being concealed by a cover and having a throttle valve that regulates air to be sucked, comprising;

a throttle body installed inside the engine that accommodates the throttle valve;

an actuator fastened to the throttle body to drive the throttle valve to open or close; and a second throttle valve driver that enables the throttle valve to be driven manually to open or close, wherein the throttle body is placed in the cover at a position close to the boat.

2. An outboard motor according to claim 1, wherein the actuator drives a shaft of the throttle valve through a gear mechanism to drive the throttle valve.

3. An outboard motor according to claim 2, wherein the gear mechanism includes;

an actuator gear connected to the actuator;

a first gear meshed with the actuator gear and having more teeth than those of the actuator gear;

a second gear meshed with the first gear and having fewer teeth than those of the first gear; and a third gear connected to the shaft of the throttle valve and meshed with the second gear.

4. An outboard motor according to claim 1, wherein the actuator is an electric motor.

5. An outboard motor according to claim 1, wherein the second throttle valve driver is a knob that is connected to a shaft of the throttle valve and is formed in a shape to be manually handled.

6. An outboard motor according to claim 1, wherein the second throttle valve driver is placed at a position close to the boat.

7. An outboard motor mounted on a stern of a boat and having an internal combustion engine at its upper portion and a propeller with a rudder at its lower portion that is powered by the engine to propel the boat, the engine being concealed by a cover and having a throttle valve that regulates air to be sucked, comprising:

a throttle body installed inside the engine that accommodates the throttle valve;

an actuator fastened to the throttle body to drive the throttle valve to open or close; and a second throttle valve driver that enables the throttle valve to be driven manually to open or close;

wherein the throttle body is placed in the cover at a position close to the boat, wherein the second throttle valve driver is a knob that is connected to a shaft of the throttle valve and is formed in a shape to be manually handled, and wherein the knob is concealed by a detachable cover.

* * * * *